United States Patent [19]

Nilsson

[11] Patent Number: 4,889,176

[45] Date of Patent: Dec. 26, 1989

[54] DEVICE IN ROLL-UP DOORS

[75] Inventor: Ulf C. Nilsson, Halmstad, Sweden

[73] Assignee: Nomafa AB, Gamletullsgatan, Sweden

[21] Appl. No.: 249,571

[22] PCT Filed: Apr. 13, 1987

[86] PCT No.: PCT/SE87/00185

§ 371 Date: Sep. 16, 1988

§ 102(e) Date: Sep. 16, 1988

[87] PCT Pub. No.: WO87/06299

PCT Pub. Date: Oct. 22, 1987

[30] Foreign Application Priority Data

Apr. 17, 1986 [SE] Sweden ..... 8601757

[51] Int. Cl.[4] ..... A47G 5/02

[52] U.S. Cl. ..... 160/264; 160/266

[58] Field of Search ..... 160/264, 275, 274, 266

[56] References Cited

U.S. PATENT DOCUMENTS 1,833,140 11/1931 Traut ..... 160/264

*Primary Examiner*—Blair M. Johnson

*Attorney, Agent, or Firm*—Kane, Dalsimer, Sullivan, Kurucz, Levy, Eisele & Richard

[57] ABSTRACT

Reinforcement elements intended for use in door leaves of the kind consisting of fabric or similar flexible material. The reinforcement elements preferably are in the shape of tubes and have end pieces attached to their ends for cooperation with a profiled guiding member mounted in the door-frame of the door leaf in such a manner that when the door is being closed said reinforcement elements will be positioned at different predetermined levels of the door leaf, thus strengthening the latter to prevent bulging of the door leaf when the latter is exposed to heavy winds.

7 Claims, 2 Drawing Sheets

DEVICE IN ROLL-UP DOORS

The subject invention concerns an improved roll-up door and particularly a device in roll-up doors of the kind comprising at least one flexible door leaf which may be wound onto a roller. Doors of this kind are generally intended for door openings which are large enough to allow passage-through of vehicles of considerable dimensions, for which reason the door leaf, usually in the form of a fabric, must have a considerable surface area. When powerful winds blow against doors made from fabric having a large surface area considerable problems may arise because the fabric will bend and bulge to an unacceptable degree. This may cause difficulties, such as sealing difficulties, particularly against the door-frame. The purpose of the subject invention is to remedy these problems.

The device in accordance with the invention consists of a number of reinforcement elements which extend crosswise relatively to the door leaf. The improved roll-up door is characterized therein that the reinforcement element or elements are not connected to the door leaf and are provided with end pieces which are arranged to cooperate dimensionally with abutments provided in profiled guiding members, located in the door frame for the purpose of setting said reinforcement elements at different predetermined levels.

Further advantages and characteristics will appear from the dependent claims and the following detailed description of a preferred embodiment.

Figure 1:
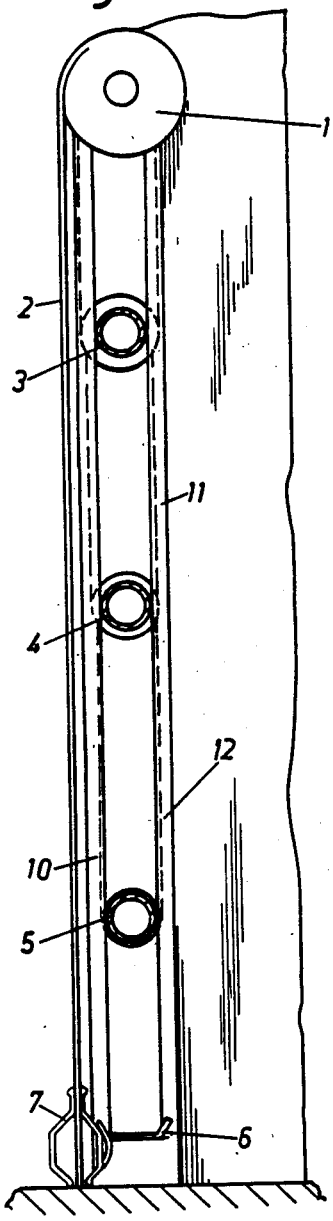
Figure 4:
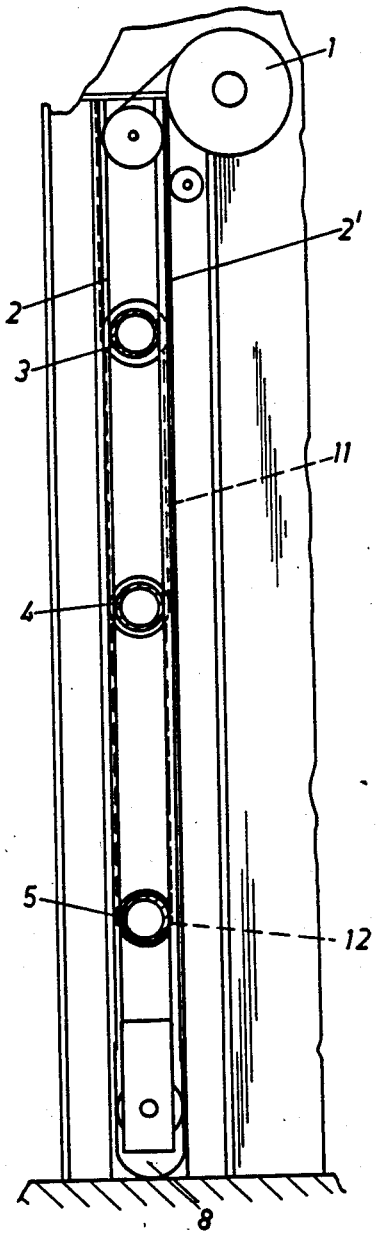
Figure 3:
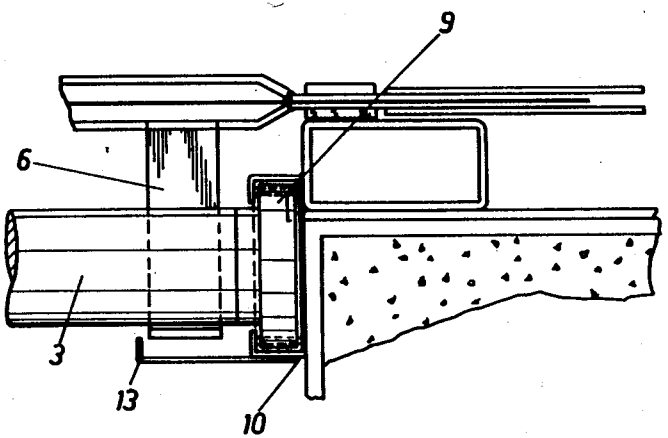
Figure 2:
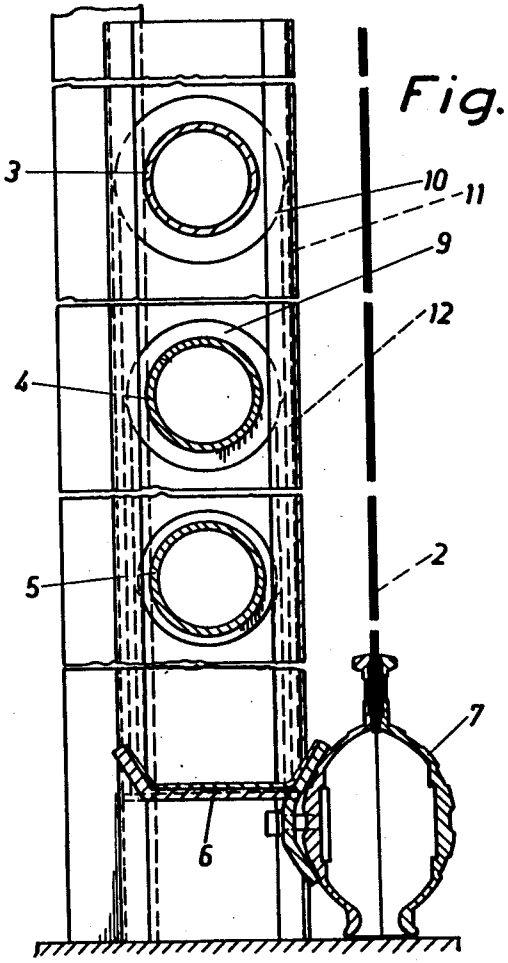

The invention will be described in closer detail in the following with reference to the accompanying drawings, wherein FIG. 1 is a lateral view of a door in accordance with the invention, FIGS. 2 and 3 illustrate, on an enlarged scale and in sectional views, details in a door in accordance with the invention, and FIG. 4 is a lateral view of a door comprising double door leaves.

The door illustrated in FIG. 1 which may be of the kind shown and described in U.S. Pat. No. 3,878,879, comprises a roll-up door leaf 2 which may be wound onto a roller 1. In accordance with the shown embodiment the door leaf 2 is of single leaf type and consists of heavy cloth. When a door of this kind is exposed to the effects of heavy wind the cloth 2 will bend, which in turn may result in sealing problems. To eliminate problems of this kind it is suggested in accordance with the teachings of the subject invention to use one or several separate reinforcement elements, preferably in the manner shown, in the form of tubular elements 3, 4, 5 or elements of some other suitable profile configuration, so that these elements extend crosswise relatively to the door leaf and across the entire width of the door. When the door is in its lower closed position the reinforcement elements 3, 4, 5 preferably will be spaced essentially equal distances apart. At its lower end the door leaf 2 is provided with a hook 6 which—as shown in FIG. 2—is attached to the door leaf 2 by means of a stiffening rib 7. When the door is being rolled up the hook therefore will lift the reinforcement elements 3, 4, 5 to a position adjacent the roll-up roller 1 of the door leaf 2 where the elements will be gathered adjacent each other.

As illustrated in FIG. 3 each end of the reinforcement elements 3, 4, 5 is provided with an end piece 9. The dimensions of the end pieces 9 are specific for each individual reinforcement element so that by providing profiled guiding members 10 which cooperate with the end pieces, with insets at unequal spacings, as illustrated in FIGS. 1 and 2—see details 11, 12—it becomes possible to make the reinforcement elements 3, 4, 5 stop in the desired vertical positions when the door is being closed.

To protect the hook 6 the profiled guiding member 10 preferably is provided with a protective guard 13. Preferably, the protective guard 13 is pivotable or easily removable to make the protected components easily accessible for servicing, when required.

FIG. 4 illustrates a double-leaf door 2, 2'. In accordance with this embodiment the reinforcement elements 3, 4, 5 are positioned intermediate the two door leaves 2, 2' and consequently there is no need to use a hook of the kind shown in FIG. 1 and designated in that drawingfigure by numeral reference 6.

It is sufficient to provide a stiffening element 8 at the lower end of the door leaves 2, 2'. In other respects the reinforcement elements 3, 4, 5 function in a manner identical with that described in connection with FIG. 1.

The invention is not limited to the embodiments shown and described in the aforegoing but a number of modifications are possible within the scope of the appended claims. As already mentioned in the aforeging it is possible to use reinforcement elements 3, 4, 5 of cross-sectional configurations different from that shown. The hook 6 intended to lift the reinforcement elements 3, 4, 5 may be attached to the door leaf 2 in any convenient manner other than that shown.

What is claimed is:

1. A device in roll-up doors of the kind comprising at least one flexible door leaf (2) which is arranged to be wound onto a roller (1), said device comprising at least one reinforcement element (3, 4, 5) which extends crosswise relatively to the door leaf, characterized therein that the reinforcement element or elements (3, 4, 5) are not connected to said door leaf (2) and are provided with end pieces (9) which are arranged to cooperate dimensionally with abutments (11, 12) provided in profiled guiding members (10) located in the door frame for the purpose of setting said reinforcement elements (3, 4, 5) at different predetermined levels, said profiled guiding members having reinforcement element receiving openings for passage therethrough of respective reinforcement elements, and further that the cross-sectional dimension of the end pieces (9) at the ends of the reinforcement elements (3, 4, 5) exceeds the cross-sectional dimension of each respective guiding member at its respective abutment (11, 12) establishing cooperation between said reinforcement elements and said abutments (11, 12) and further that the cross-sectional dimension of said end pieces (9) at the ends of the reinforcement elements (3, 4, 5) exceeds the cross-sectional dimension of said reinforcement element receiving openings.

2. A device as claimed in claim 1, characterized therein that said profiled guiding member (10) is provided with a protective guard (13).

3. A device as claimed in claim 1, characterized therein that said reinforcement elements are in the shape of tubes.

4. An improved roll-up door, said door having side frames and including at least one flexible door leaf and a roller, said door leaf arranged to be wound on and wound off said roller to respectively raise and lower said door leaf between said side frames of said door, and further including at least one elongated reinforcement element extending crosswise relative to said door leaf across the entire width of the door and suspended independently of said door leaf and not connected to said door leaf, wherein the improvement comprises:

an end piece at each end of each said elongated reinforcement element, each said end piece having a given width dimension; and profiled guiding members in said side frames of said door, said profiled guiding members extending vertically along said side frames from the top to the bottom of said door and having a width dimension which decreases from the top of said profiled guiding members to the bottom to cooperate with said end pieces of each said elongated reinforcement element to stop each in a predetermined vertical position when said door is closed; and lifting means at the bottom of said door leaf to engage with each said elongated reinforcement element so that each said elongated reinforcement element is raised when said improved roll-up door is opened and is lowered when said improved roll-up door is closed.

5. An improved roll-up door as claimed in claim 4 wherein said elongated reinforcement element has a tubular shape.

6. An improved roll-up door as claimed in claim 4, wherein the width dimension of said end pieces at the ends of said elongated reinforcement element exceeds the width dimension of said elongated reinforcement element.

7. An improved roll-up door as claimed in claim 4, further comprising a protective guard on each of said profiled guiding members.

* * * * *